US008267003B1

(12) United States Patent
Lou et al.

(10) Patent No.: US 8,267,003 B1
(45) Date of Patent: Sep. 18, 2012

(54) BLAST RESISTANT ARMOR MOUNTING HARDWARE

(75) Inventors: Ken-An Lou, Phoenix, AZ (US); Matthew Luster, Mesa, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 289 days.

(21) Appl. No.: 12/854,054

(22) Filed: Aug. 10, 2010

Related U.S. Application Data

(60) Provisional application No. 61/273,904, filed on Aug. 11, 2009.

(51) Int. Cl.
*F41H 7/00* (2006.01)
*F41H 5/013* (2006.01)

(52) U.S. Cl. ..... 89/36.08; 89/918; 89/929

(58) Field of Classification Search ..... 89/36.01, 89/36.09, 36.11, 36.12, 918, 929; 411/537; 403/408.1, 167, 168
See application file for complete search history.

(56) References Cited

U.S. PATENT DOCUMENTS 1,345,358 A * 7/1920 Fuller ..... 403/390
2,202,405 A * 5/1940 Smith ..... 219/107
3,135,154 A * 6/1964 Zenzic ..... 411/12
3,149,863 A * 9/1964 Melton et al. ..... 403/125
3,220,289 A * 11/1965 Farekas ..... 82/147
3,382,630 A * 5/1968 Chivers ..... 52/208
3,695,386 A * 10/1972 Thien et al. ..... 181/204
3,835,615 A * 9/1974 King, Jr. ..... 403/408.1
4,167,889 A * 9/1979 Bohne et al. ..... 89/36.02
4,204,374 A * 5/1980 Olson ..... 52/208
4,324,517 A * 4/1982 Dey ..... 411/353
4,326,445 A 4/1982 Bemiss
4,398,446 A * 8/1983 Pagano et al. ..... 89/36.08
4,468,161 A * 8/1984 Krueger ..... 411/171
4,565,495 A * 1/1986 MacLeod, Jr. ..... 416/224
4,671,583 A * 6/1987 Olson et al. ..... 439/92
4,841,838 A * 6/1989 Scully et al. ..... 89/36.08
5,200,256 A 4/1993 Dunbar
5,326,206 A * 7/1994 Moore ..... 411/113
5,533,781 A * 7/1996 Williams ..... 296/204
5,542,777 A * 8/1996 Johnson ..... 403/389
5,560,666 A * 10/1996 Vieira et al. ..... 296/3
5,663,520 A 9/1997 Ladika
5,679,918 A 10/1997 Korpi
5,697,650 A * 12/1997 Brown ..... 285/197
5,822,936 A * 10/1998 Bateman ..... 52/281
5,928,395 A * 7/1999 Glen et al. ..... 55/378
6,523,450 B1 2/2003 Schreiber
6,755,601 B2 * 6/2004 Ohta ..... 411/171
6,779,431 B2 8/2004 Honlinger
7,056,053 B2 * 6/2006 Schilling et al. ..... 403/337
7,255,034 B2 8/2007 Strassgurtl
7,458,306 B2 12/2008 Singh
7,588,386 B2 * 9/2009 Kielczewski et al. ..... 403/408.1
7,712,409 B2 5/2010 Cunningham (Continued)

*Primary Examiner* — Bret Hayes
*Assistant Examiner* — Joshua Freeman
(74) *Attorney, Agent, or Firm* — James L. Farmer

(57) ABSTRACT

Methods and apparatus are provided for attaching a rigid armor plate to the exterior of a vehicle hull. The exemplary system includes an armor attachment point on the vehicle hull, a hole through the armor plate in alignment with the armor attachment point, and a fastener extending through the hole connecting the armor plate to the vehicle hull. The hole through the armor plate may be larger than the fastener, defining a circumferential gap between the fastener and armor plate. The fastener may comprise a material with an energy absorption capability in excess of 2,000 ksi, and more preferably in excess of 5,000 ksi.

16 Claims, 4 Drawing Sheets

U.S. PATENT DOCUMENTS

| | | | | |
|---|---|---|---|---|
| 7,712,823 | B2 | 5/2010 | Greuter | |
| 7,726,924 | B2 * | 6/2010 | Lu | 411/171 |
| 8,020,483 | B2 * | 9/2011 | Benyami et al. | 89/36.17 |
| 2004/0101384 | A1 * | 5/2004 | Schilling et al. | 411/537 |
| 2005/0224651 | A1 * | 10/2005 | Glockler | 244/122 R |
| 2005/0260034 | A1 * | 11/2005 | Arbona | 403/408.1 |
| 2008/0127961 | A1 * | 6/2008 | McPherson | 124/88 |
| 2008/0289143 | A1 * | 11/2008 | Lu | 16/2.4 |

* cited by examiner

FIG. 1
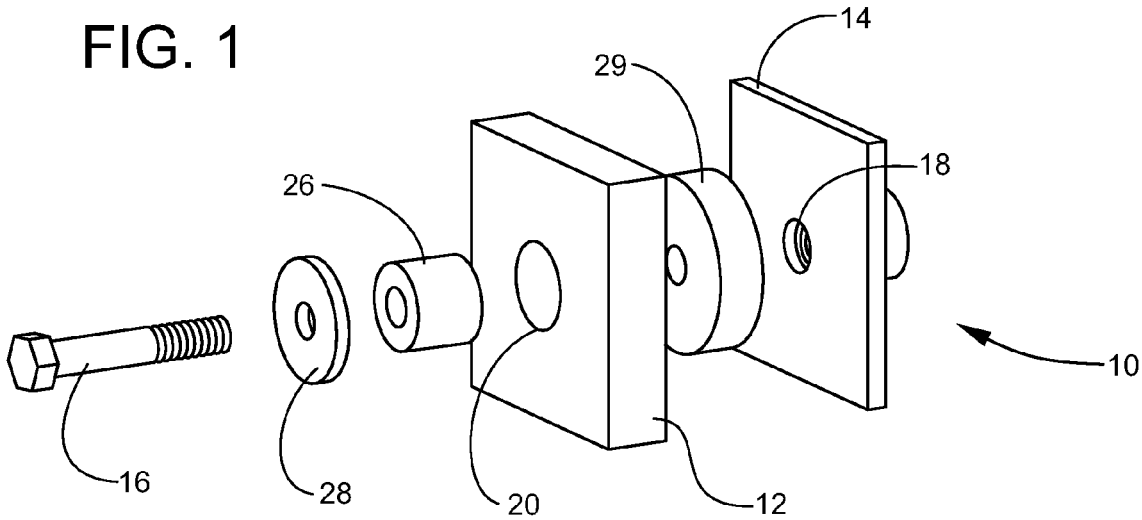
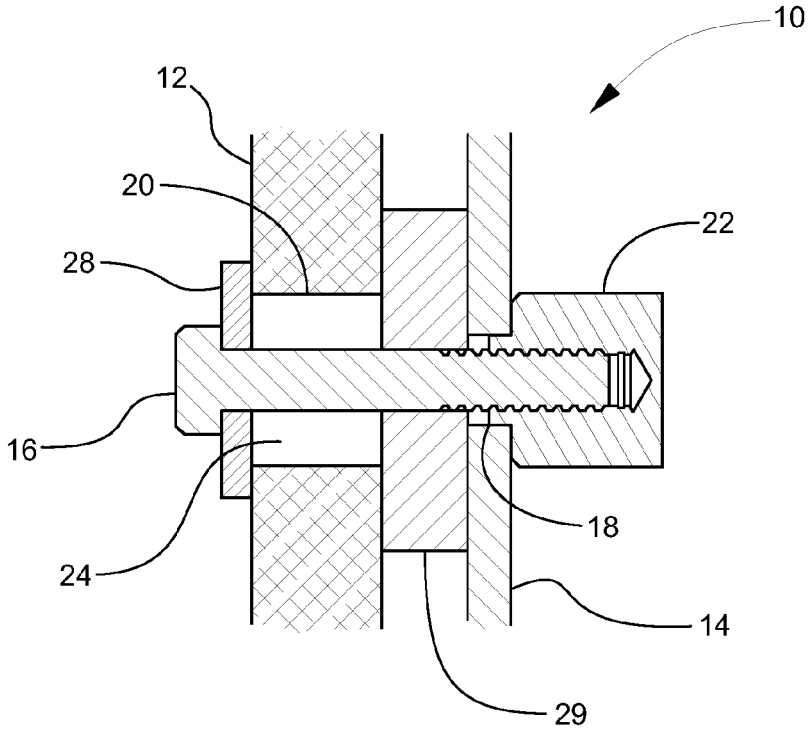
FIG. 2

BLAST RESISTANT ARMOR MOUNTING HARDWARE

STATEMENT REGARDING FEDERALLY SPONSORED RESEARCH OR DEVELOPMENT

This invention was made with government support under contract number W56 HZV-07-C-0512 awarded by the US Army TACOM LCMC. The government has certain rights in the invention.

TECHNICAL FIELD

The present invention generally relates to vehicle armor, and more particularly relates to system for attaching an armor plate to the exterior surface of a vehicle hull.

BACKGROUND

Blast protection appliqués are used on tactical and combat ground vehicles as a method of deflecting or mitigating the effects of anti-vehicular mine blasts or attack by Improvised Explosive Devices (IEDs). The appliqués essentially comprise armor plating attached to the outer surfaces of the bottom and sides of the vehicle. The armor plating may be made of various high strength and blast resistant materials such as steel, titanium, or various composite materials including ceramic composites.

A critical and limiting element of these appliqués is the fastener joints. Currently, industrial bolts are commonly used for attaching blast protection appliqués to vehicles due to their simplicity and availability. The fasteners used are typically selected for strength and ability to transmit externally applied loads. The vast majority of commercially available high strength fasteners are made of carbon steel. Examples include ASTM A325 high-strength carbon steel bolts, ASTM A490 alloy steel bolts, and SAE J429 graded bolts, such as Grade 5 and Grade 8. However, under blast conditions these bolts often fail, resulting in secondary fragments and projectiles which may inflict additional damage and injury to the vehicle personnel. In addition the performance of vehicle armor attachment joints under blast threat or ballistic impact is poorly understood, in part because the blast and ballistic loadings are wide range dynamic events.

Accordingly a need exists for innovative methodology and/or material with which blast protection appliqués could be attached so as to withstand blast forces and pressures of an anti-vehicular mine blast.

SUMMARY

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment" does not necessarily refer to the same embodiment, although it may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises an apparatus for attaching a rigid armor plate to the exterior of a vehicle hull. The apparatus comprises an armor attachment point on the vehicle hull, an oversized hole through the armor plate in alignment with the armor attachment point, and a fastener extending through the oversized hole and attaching the armor plate to the armor attachment point, such that the fastener and oversized hole cooperatively define a substantial gap there-between.

According to another exemplary embodiment, the fastener is a threaded bolt with a head, and the armor attachment point comprises a clear hole in the vehicle hull and an internally threaded nut.

According to another exemplary embodiment, the internally threaded nut is a threaded weld bushing.

According to another exemplary embodiment, the apparatus further comprises a washer under the head of the bolt that overlaps a portion of the armor plate around the oversized hole.

According to another exemplary embodiment, the apparatus further comprises an elastic insert bushing disposed about the fastener, substantially filling the gap between the fastener and oversized hole.

According to another exemplary embodiment, the elastic insert bushing material is selected from the group comprising rubber, and polyurethane.

According to another exemplary embodiment, the apparatus further comprises an elastic spacer around the bolt between the armor plate and the vehicle hull.

According to another exemplary embodiment, the fastener material has an energy absorption capability in excess of 2000 ksi, and more preferably an energy absorption capability in excess of 5000 ksi.

According to another exemplary embodiment, the fastener is a threaded bolt made of 304 Stainless Steel.

According to another exemplary embodiment, the apparatus comprises a washer-shaped pivot cup residing in a countersink in the exterior end of the oversized hole in the armor plate, a spherical countersink in the inner diameter of the exterior side of the pivot cup, and a pivot washer trapped between an end of the fastener and the pivot cup, where the pivot washer has a spherical surface configured for pivoting engagement with the spherical countersink in the pivot cup.

According to another exemplary embodiment, the inner diameter of the pivot cup is substantially greater than the diameter of the fastener.

In another exemplary embodiment, the disclosure comprises a system for attaching a rigid armor plate to the exterior of a vehicle hull. The system comprises an armor attachment point on the vehicle hull, a hole through the armor plate in alignment with the armor attachment point, and a fastener extending through the hole and attaching the armor plate to the armor attachment point, wherein the fastener material has an energy absorption capability in excess of 2000 ksi., and more preferably an energy absorption capability in excess of 5000 ksi.

According to another exemplary embodiment, the fastener is a threaded bolt made of 304 Stainless Steel.

According to another exemplary embodiment, the diameter of the fastener is less than the diameter of the hole through the armor plate, defining a substantial gap there-between.

Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing figures, wherein like numerals denote like elements, and wherein:

FIG. 1 is an exploded perspective view of an exemplary blast resistant armor attachment joint;

FIG. 2 is a cross section view of the armor attachment joint of FIG. 1;

DETAILED DESCRIPTION

Figure 3:
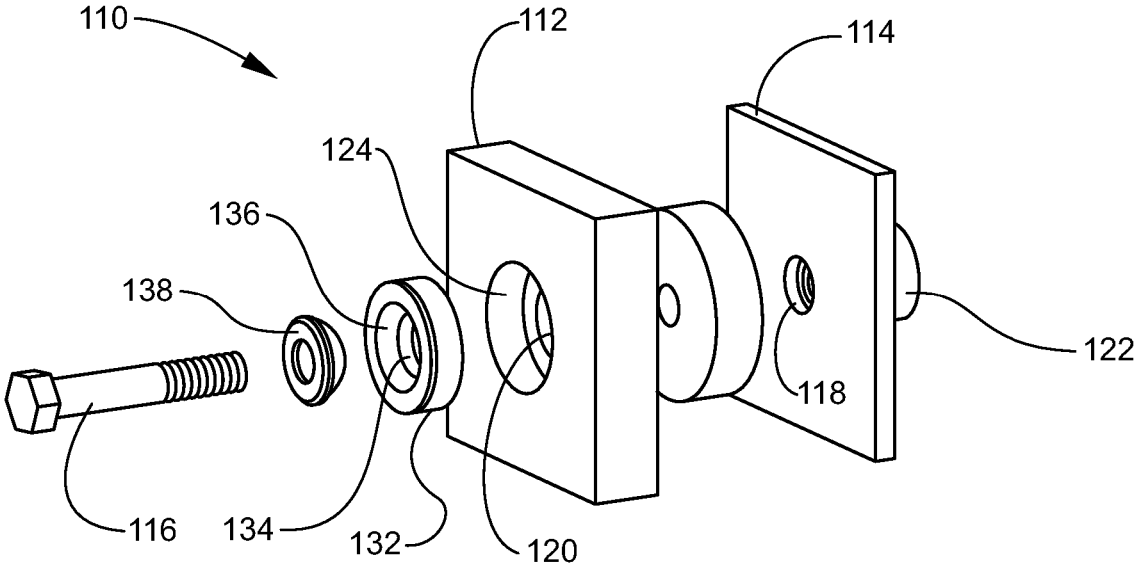
FIG. 3 is an exploded perspective view of another exemplary blast resistant armor attachment joint.

The present invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Floating Armor Joint Design

Referring now to FIGS. 1 and 2, the present invention comprises generally an armor attachment joint 10 in which an armor plate 12 is attached to an outer surface of a vehicle hull 14 with a blast resistant fastener 16. It should be understood that attachment joint 10 is intended to represent one of several such attachment joints that would typically secure a single armor plate 12 to a portion of the vehicle hull. In one preferred embodiment the joint 10 includes a clear-hole 18 in vehicle hull 14 and a co-aligned oversized hole 20 in armor plate 12 for receiving fastener 16. Fastener 16 is preferably inserted from the outside of the armor appliqué plate 12 through holes 20 and 18, and threaded into a nut 22 behind hull 14. The nut 22 may be a conventional machine nut, or more preferably a threaded weld bushing permanently affixed to the vehicle panel as shown.

As seen in FIG. 2, oversized hole 20 is substantially larger than fastener 16, defining a circumferential gap 24 there-between. For example in one embodiment the diameter of oversized hole 20 is about two to four times the diameter of fastener 16, and more preferably about three times the diameter of fastener 16. An optional elastic insert bushing 26 disposed about fastener 16 within hole 20 may be used to effectively fill the cylindrical gap 24 and facilitate alignment of the hole 20 in the armor plate 12 to the armor attachment point. The elastic insert bushing 26 may be comprised of any suitable resilient material, such as rubber, polyurethane, or the like. A structural washer 28 under the head of fastener 16 overlaps armor plate 12 around hole 20, thus providing a direct load path between the fastener and armor plate. The armor plate 12 may be spaced apart from the vehicle hull 14 using a resilient spacer 29, also preferably comprised of a durable elastic material such as for example polyurethane. As discussed in greater detail below, the metal fastener elements of the joint, including at least fastener 16, and nut 22, are preferably made of a material exhibiting both high strength and a relatively high percent elongation to failure.

One typical failure mode of prior art joints occurs as a result of in-plane movement of the armor plate relative to the vehicle hull, causing the bolt to be effectively sheared off by the armor. Advantageously the oversized hole 20 of the present embodiment allows armor plate 12 to shift, or float relative to the vehicle hull to a certain extent without coming into direct contact with fastener 16. The centering effect provided by the elastic insert 26 helps to ensure a symmetric circumferential gap between the fastener 16 and armor plate 12 at each joint. As a result, shear loads applied to the fastener during a blast event are greatly reduced or eliminated, substantially improving fastener survivability.

Pivoting Joint Design

Figure 4:
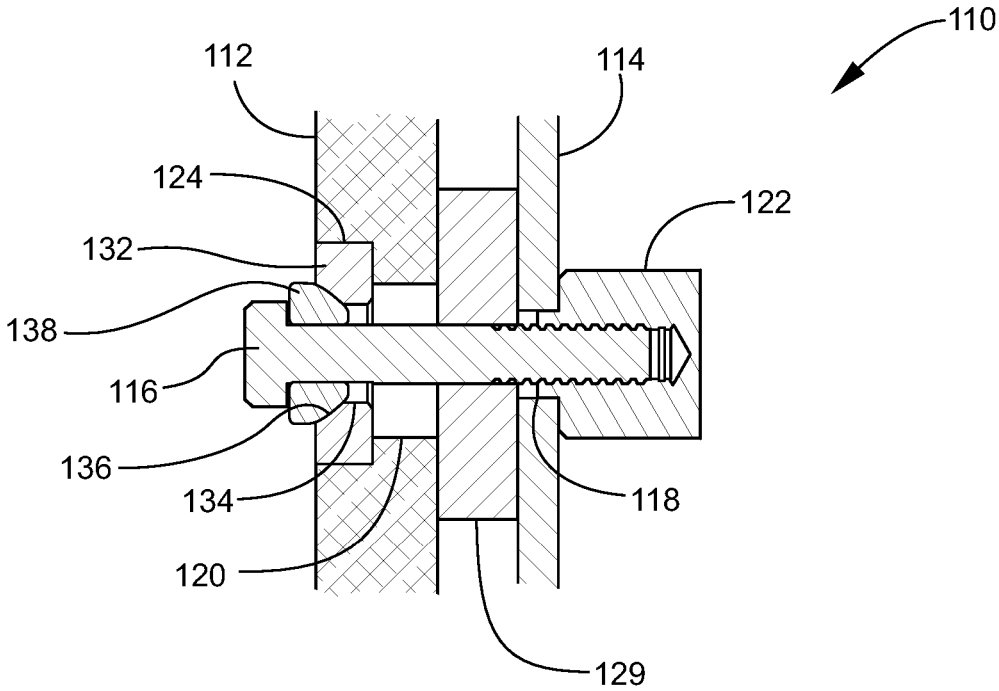
FIG. 4 is a cross section view of the armor attachment joint of FIG. 3.

FIGS. 3 and 4 depict another preferred embodiment of the armor appliqué attachment joint. In this embodiment an attachment joint 110 comprises an armor plate 112, again attached to an outer surface of a vehicle hull 114 at a predefined armor attachment point with a blast resistant fastener 116. The armor attachment point preferably comprises a clear-hole 118, and nut or threaded weld bushing 122. Armor panel 112 includes an oversized hole 120 for receiving fastener 116, the exterior end of which includes a countersink 124 for accepting a recessed pivot cup 132. The pivot cup 132 is generally washer-shaped, with a relatively large through-hole 134 to provide clearance around the fastener 116. The exterior end of through-hole 134 includes a spherical shaped countersink 136 for accepting a corresponding spherical surface of a pivot washer 138. The pivot washer 138 and pivot cup 132 provide a direct load path from the fastener 116 to the armor plate 112, and ensure that fastener 116 stays centered within hole 120 of armor plate 112. The pivot washer and pivot cup are preferably made from a harden-able material such as 4000 series alloy steel. An optional resilient spacer 129 may be included between armor plate 112 and vehicle panel 114 to add compliance to the joint 110, and to help attenuate the impulse transmitted to the vehicle from a mine-blast event. The metal fastener 116 and nut 122 are again preferably made of material that exhibits the desired combination of relatively high strength and high elongation.

As in the previously described floating armor joint design of FIGS. 1 and 2, the joint design of the present embodiment significantly enhances survivability of the fastener. The oversized hole 120 in armor plate 112 together with the pivot washer 138 and pivot cup 132 cooperate to reduce shearing of the fastener. More particularly, the oversized hole 120 allows for substantial movement of the armor to occur without direct contact between the armor and fastener 116. Also, similar to the benefit provided by the elastic insert 26 of the previous embodiment, the centering effect of the pivot washer 138 and pivot cup 132 ensures that the gap between the fastener 116 and hole 120 is substantially symmetric at each joint. As a result the potential for imparting shear forces to the fastener is minimized regardless as to the direction of armor movement under blast conditions.

Figure 5:
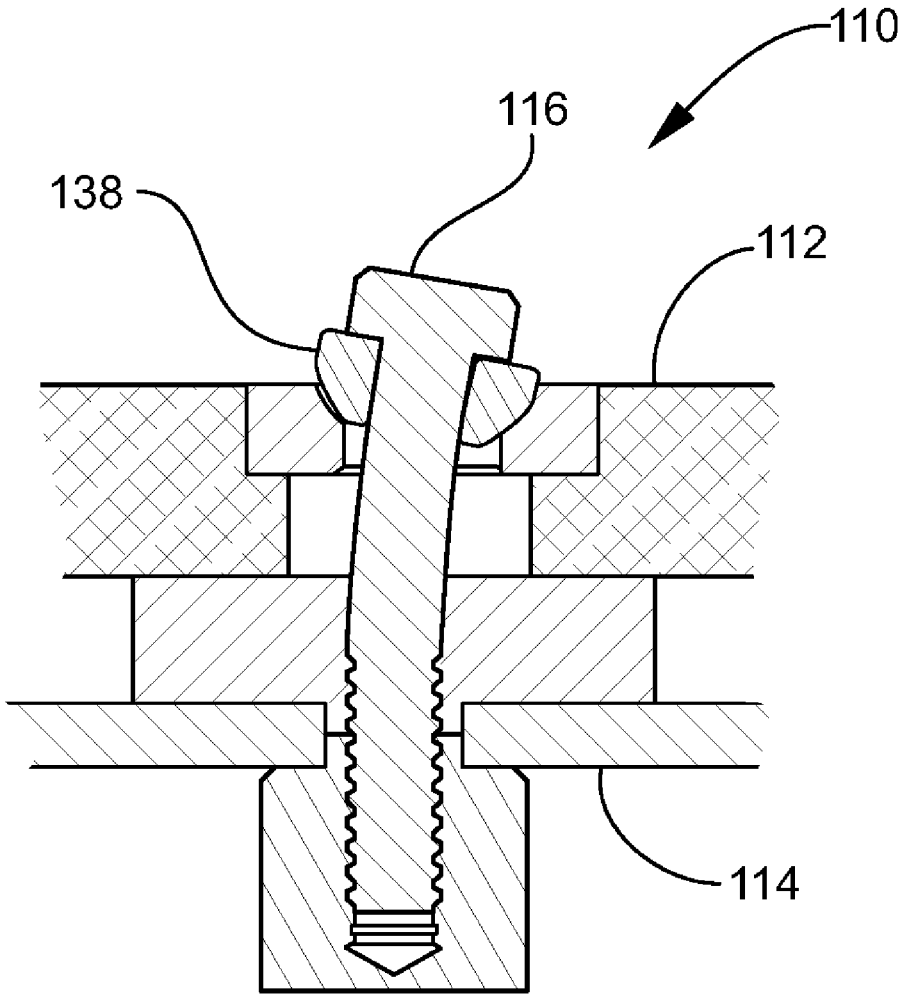
FIG. 5 is another cross section view of the armor attachment joint of FIG. 3 depicting a misaligned condition.

In addition, the spherical interface between the pivot washer 138 and pivot cup 132 allows the pivot washer, and consequently the fastener 116, to tilt in response to armor plate movement. FIG. 5 shows such a condition, with the armor plate 112 shifted out of alignment with the vehicle attachment point. As can be seen, the head of the fastener 116 is flush against the pivot washer 138, and both are tilted to accommodate the bending and tilting of the fastener. The ability of the pivot washer to tilt under the head of the fastener substantially prevents the armor plate 112 from imparting a moment constraint to the end of the fastener 116. Advantageously, this reduction in moment constraint acts to mitigate the shear stress in the fastener, thus improving survivability of the fastener and the joint 110.

Fastener Material

The inventors of the present invention have discovered that a particularly significant property affecting survivability of the fastener during blast events is the material's energy absorption capability (hereinafter "EAC"). In particular the inventors have discovered that fastener survivability under impact or blast loading conditions is dependent not just on the strength of the material, but also on the amount the fastener can deform or extend prior to failure. Higher survivability relates to higher strength combined with greater total deformation leading up to failure. A good indicator of a fastener's total deformation prior to failure is the measured percent elongation of the material used for the fastener. Thus materials that exhibit both relatively high strength values and high percent elongation are preferable candidates for fastener materials.

The EAC is generally understood to mean the area under the stress strain curve for any particular material. The inventors further recognized that fastener survivability is closely linked to an approximation of the EAC obtained by taking the average of material yield strength and tensile strength (in ksi) multiplied by the elongation (in percentage times 100).

Table 1 lists selected relevant material properties for a variety of commercial metallic fasteners. Included in the table are values for Yield and Tensile (Ultimate) strengths, percent Elongation, and a calculated value for the EAC based on the foregoing property values. The strength properties range from the lowest yield stress of 25 ksi for a NICU-A-HF bolt made of Nickel-copper alloy A, to the highest yield stress of 135 ksi for a 410-HT bolt made of Martensitic stainless steel. As previously mentioned, fasteners used for attaching armor appliqué to vehicles are typically selected based upon strength. For example, typical common high strength steel fasteners currently used for armor attachment include ASTM A354 Grade BD, and SAE J429 Grade 8 bolts, among many others.

TABLE 1

Material Properties for Common Industrial Fasteners

| Specification | Material | Yield Strength (ksi) | Tensile Strength (ksi) | El (%) | EAC (ksi) |
|---|---|---|---|---|---|
| NICU-A-HF | Nickel-copper alloy A | 25 | 70 | 20 | 950 |
| 464 | Naval Brass | 27 | 60 | 25 | 1088 |
| 303A | Austenitic Stainless steel | 30 | 75 | 20 | 1050 |
| 6061-T6 | Aluminum alloy | 35 | 42 | 12 | 462 |
| 2024-T4 | Aluminum alloy | 40 | 55 | 14 | 665 |
| 614 | Aluminum Bronze | 40 | 75 | 30 | 1725 |
| UNS R50400 | Grade 2 Titanium | 50 | 70 | 27 | 1620 |
| SAE J429 Grade 2 | Low or medium carbon steel | 57 | 74 | NA | NA |
| SAE J429 Grade 5 | Medium carbon steel | 92 | 120 | 14 | 1484 |
| ASTM A449 Type 1 | Medium carbon steel | 92 | 120 | NA | NA |
| ASTM A325 Type 1 | Medium carbon steel | 92 | 120 | NA | NA |
| 410-H and 416-H | Martensitic stainless steel | 95 | 125 | 20 | 2200 |
| ASTM A354 Grade BD | Medium Carbon alloy steel (min tempering temp 850 F.) | 99 | 115 | 16 | 1712 |
| SAE J429 Grade 8 | Medium Carbon alloy steel | 130 | 150 | 12 | 1680 |
| ASTM A354 Grade BD | Medium Carbon alloy steel | 130 | 150 | NA | NA |
| ASTM A490 Type 1 | Medium Carbon alloy steel | 130 | 150 | NA | NA |
| 410-HT and 416-HT | Martensitic stainless steel | 135 | 180 | 12 | 1890 |

Table 2 lists properties of rods, bars, and forgings for a wide range of potentially suitable fastener materials. The materials are grouped into categories beginning with Steel, followed by Stainless Steel, and so on. Included in the table are calculated EAC values. As can be seen, EAC values range from as low as 230 for 1100H18 Aluminum, to 6464 for Haynes 25. Notably, the EAC values in Table 1 for the high strength steel fastener examples cited above are around 1700, or toward the low end of the range of EAC values in Table 2. In contrast, 304 stainless steel for example, with a calculated EAC of 5550, falls relatively near the high end of the range of Table 2. Significantly, the inventors have determined that the fastener materials in Table 2 with an EAC greater than 2000 are more likely to survive a blast load event, and thus preferred over materials with an EAC below 2000, such as the high strength alloy steel fasteners. The inventors have further determined that materials such as 304 stainless steel for example, with a calculated EAC greater than 5000, are able to survive substantially greater blast loads than most other potential fastener materials, and thus are particularly preferred choices.

TABLE 2

Properties of Rods, Bars, and Forgings

| Material (density) Lbs/in3 | Modulus (msi) | Yield Strength (ksi) | Tensile Strength (ksi) | Elongation % | EAC (ksi) |
|---|---|---|---|---|---|
| Steel | | | | | |
| 1006HR (0.283) | 29.5 | 24 | 43 | 30 | 1005 |
| 1006CD (0.283) | 29.5 | 41 | 48 | 20 | 890 |
| 1095HR (0.283) | 29.5 | 66 | 120 | 10 | 930 |
| 1095CD (0.283) | 29.5 | 76 | 99 | 10 | 875 |
| 1111HR (0.283) | 29.5 | 33 | 55 | 25 | 1100 |
| 1111CD (0.283) | 29.5 | 58 | 75 | 10 | 665 |
| 1524HR (0.283) | 29.5 | 41 | 74 | 20 | 1150 |
| 1524CD (0.283) | 29.5 | 69 | 82 | 12 | 906 |
| 4130 (0.283) | 29.5 | 89 | 98 | 28 | 2618 |
| 4130 (0.283) | 29.5 | 197 | 234 | 12 | 2586 |
| 4063 (0.283) | 29.5 | 103 | 114 | 24 | 2604 |
| 4063 (0.283) | 29.5 | 257 | 345 | 4 | 1204 |
| Stainless Steel | | | | | |
| 17-4PH (0.281) | 28.5 | 185 | 210 | 14 | 2765 |
| 15-5PH (0.282) | 28.5 | 125 | 145 | 19 | 2565 |
| 304 (0.29) | 28 | 75 | 110 | 60 | 5550 |
| 316 (0.29) | 28 | 42 | 84 | 50 | 3150 |
| 316 (0.29) | 28 | 30 | 80 | 60 | 3300 |
| 430 (0.28) | 29 | 40 | 45 | 30 | 1275 |
| 416 (0.28) | 29 | 40 | 75 | 30 | 1725 |
| 440C (0.28) | 29 | 65 | 110 | 14 | 1225 |
| 302HQ (0.29) | 28 | 27 | 73 | 65 | 3250 |
| 211 (0.284) | 28.6 | 31 | 87 | 60 | 3540 |
| Nitronic 60 (0.274) | 26.2 | 58 | 102 | 62 | 4960 |
| 316F (0.29) | 29 | 35 | 80 | 57 | 3278 |
| Superalloys (iron) | | | | | |
| Multimet N-155 (0.296) | 28.8 | 58 | 118 | 49 | 4312 |
| Incoloy 800 (0.287) | 28.5 | 44 | 88 | 45 | 2970 |
| Incoloy 801 (0.287) | 29 | 40 | 90 | 40 | 2600 |
| Aluminum Alloys | | | | | |
| 1100 (0.098) | 10 | 5 | 13 | 40 | 360 |
| 1100H18 (0.098) | 10 | 22 | 24 | 10 | 230 |
| 5056H38 (0.095) | 10.3 | 50 | 60 | 15 | 825 |
| 5456 (0.096) | 10.3 | 23 | 45 | 24 | 816 |
| 5456H116 (0.096) | 10.3 | 37 | 51 | 16 | 704 |
| 6061T6 (0.098) | 10 | 40 | 45 | 16 | 680 |
| 7075T6 (0.101) | 10.4 | 73 | 83 | 11 | 858 |
| Other Alloys | | | | | |
| Hafnium (0.47) | 1.57 | 32 | 77 | 24 | 1308 |
| Hafnium (0.47) | 1.57 | 96 | 112 | 10 | 1040 |
| Haynes 188 (0.33) | 33 | 68 | 137 | 61 | 6253 |
| Haynes 25 (0.33) | 34.2 | 67 | 135 | 64 | 6464 |
| Mar M 918 (0.314) | 33 | 35 | 130 | 75 | 6188 |
| C11000 (0.321) | 17 | 10 | 32 | 50 | 1050 |
| C17200 (0.296) | 18.5 | 30 | 68 | 40 | 1960 |
| C27000 (0.306) | 15 | 14 | 47 | 8 | 244 |
| C27000 (0.306) | 25 | 60 | 90 | 62 | 4650 |
| C66700 (0.308) | 16 | 18 | 49 | 58 | 1943 |
| C66700 (0.308) | 16 | 62 | 77 | 10 | 695 |
| Magnesium Alloys | | | | | |
| 2K60A (0.066) | 6.5 | 14 | 40 | 28 | 756 |
| Nickel Alloys | | | | | |
| Permanickel 300 (0.316) | 30 | 35 | 90 | 40 | 2500 |
| Permanickel 300 (0.316) | 30 | 150 | 200 | 10 | 1750 |
| Monel 400 (0.319) | 26 | 25 | 70 | 60 | 2850 |
| Monel 400 (0.319) | 26 | 100 | 120 | 22 | 2420 |
| Hastelloy 275 (0.321) | 29.8 | 51 | 115 | 61 | 5063 |
| Incoloy 625 (0.305) | 29.7 | 53 | 124 | 59 | 5222 |
| Incoloy 617 (0.302) | 30.4 | 47 | 110 | 54 | 4239 |
| Hastelloy S (0.316) | 30.8 | 56 | 121 | 55 | 4868 |

TABLE 2-continued

Properties of Rods, Bars, and Forgings

| Material (density) Lbs/in3 | Modulus (msi) | Yield Strength (ksi) | Tensile Strength (ksi) | Elongation % | EAC (ksi) |
|---|---|---|---|---|---|
| Titanium Alloys | | | | | |
| Ti5Al2.5SNELI (0.166) | 16 | 95 | 110 | 20 | 2050 |
| Ti11.5Mo6Zr4.5Sn (0.183) | 11.1 | 128 | 141 | 17 | 2287 |
| Ti11.5Mo6Zr4.5Sn (0.183) | 11.1 | 191 | 205 | 7 | 1386 |

Small Scale Field Blast Test

Figure 6:
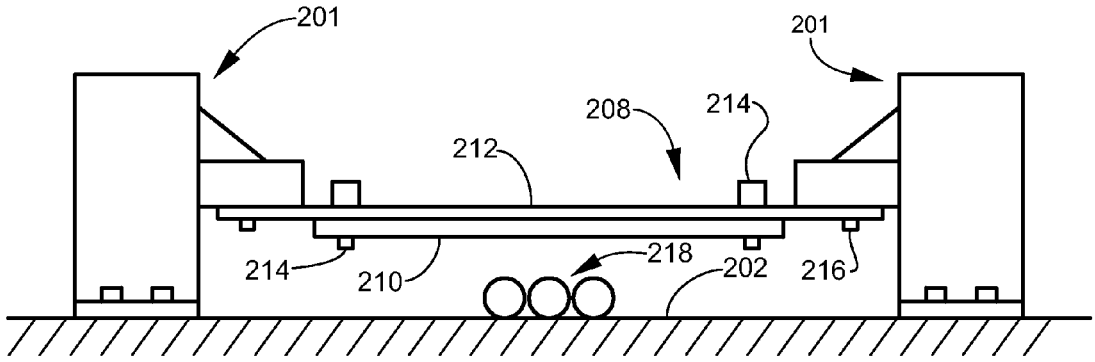
FIG. 6 is a side elevation of the set-up for the Small Scale Field Blast Test.

The relationship of the armor attachment joint design and fastener EAC to fastener survivability under blast loading conditions was experimentally verified with a small scale field blast test. Referring to FIG. 6, the test fixture used for the small scale blast test consisted of steel cantilevered support members 201 anchored to a large steel reinforced concrete reaction mass 202. A test sample assembly 208 consisted of an 18"×18"×¾" aluminum 6061-T651 plate 210 simulating the armor plate, and a 24"×24"×¼" A36 low carbon steel plate 212 for simulating the vehicle hull. The aluminum plate 210 was assembled to the steel plate 212 with four bolted joints 214, and the assembly was attached to the cantilevered support members 201 from underneath with Grade 8 industrial bolts 216. TNT explosive 218 was placed atop the reaction mass 202 underneath the center of the test sample assembly 208 to simulate an air blast event. The space between the bottom of the aluminum plate 210 and the surface of the reaction mass 202 was approximately 4 inches, and the distance from the aluminum plate to the top of the TNT charge was approximately 2¾ inches. The weight of TNT explosive used in the tests ranged from 0.1 to 1.0 lbs.

Three armor attachment joint designs for the bolted joints 214 were tested, namely a typical prior art design referred to as the "Baseline" Concept; the floating armor design of FIGS. 1, 2, referred to as "Concept #1"; and the pivoting design of FIG. 3, 4, referred to as "Concept #5. In all three tests the aluminum plate 210 was bolted to the steel panel 212 using ⅜-16 partially threaded bolts, directly, without a resilient spacer between the plate and panel. The bolts were Grade 8 alloy steel in the Baseline concept joints, and 304 Stainless Steel in the Concept #1 and Concept #5 joints.

Results of the small scale blast test are summarized in Table 3. The column labeled "Pass(P)/FAIL" indicates the condition of the bolts after the test, with P signifying that all of the bolts were intact after the test, and FAIL signifying that at least one bolt broke. The Baseline (Grade 8 bolt) concept was tested by incrementally increasing the weight of TNT charge from 0.1 to 1.0 lbs. One fastener in the Baseline concept failed with a TNT charge of 0.75 lbs, and all four fasteners failed when tested with 1.0 lbs. of TNT. None of the fasteners failed in any of the tests of the Concept #1 and Concept #5 joint designs using the 304 Stainless Steel bolts, up to and including tests with 1.0 lbs. of TNT.

TABLE 3

Small Scale Field Blast Test Results.

| Concept | Bolt Material | TNT lbs. | Pass (P)/Fail |
|---|---|---|---|
| Baseline | Grade 8 | 0.1 | P |
| Baseline | Grade 8 | 0.1 | P |
| Baseline | Grade 8 | 0.3 | P |
| Baseline | Grade 8 | 0.3 | P |
| Baseline | Grade 8 | 0.5 | P |
| Baseline | Grade 8 | 0.5 | P |
| Baseline | Grade 8 | 0.75 | FAIL |
| Baseline | Grade 8 | 1.0 | FAIL |
| #1 | SS 304 | 0.5 | P |
| #1 | SS 304 | 0.75 | P |
| #1 | SS 304 | 0.75 | P |
| #1 | SS 304 | 1.0 | P |
| #1 | SS 304 | 1.0 | P |
| #5 | SS 304 | 0.5 | P |
| #5 | SS 304 | 0.75 | P |
| #5 | SS 304 | 0.75 | P |
| #5 | SS 304 | 1.0 | P |
| #5 | SS 304 | 1.0 | P |

Full Scale Blast Simulation

Figure 7:
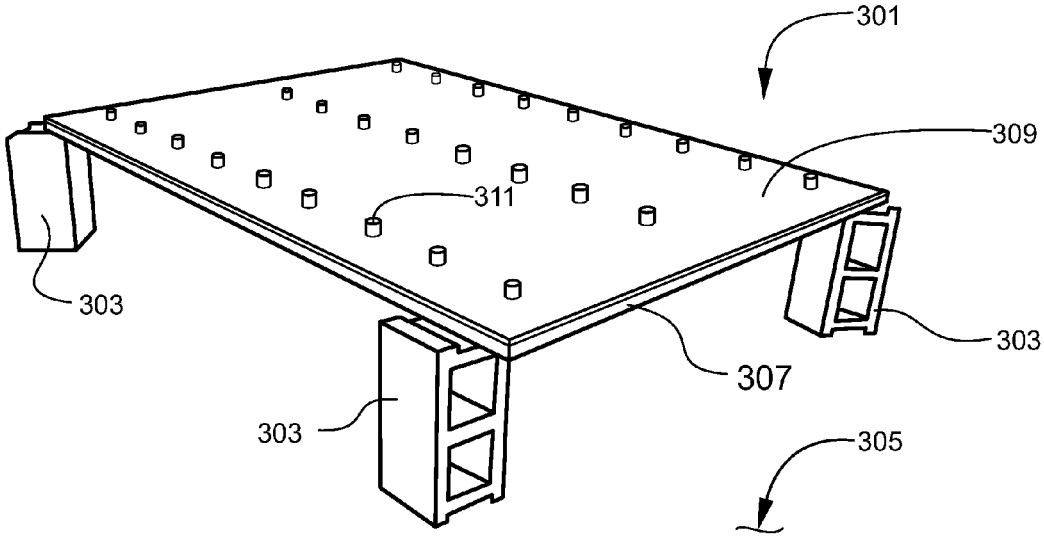
FIG. 7 is a perspective view of the set-up for the Full Scale Blast Test.

Further testing was performed to simulate a full scale blast event. FIG. 7 depicts the full scale test apparatus, comprising a rectangular test sample 301 sitting atop four concrete blocks 303 on a concrete pad 305. Several test samples 301 were constructed, each comprising a 5×7 foot×1¼ inch panel 307 of 6061 aluminum simulating an armor panel, underneath a 5×7 foot×¼ inch panel 309 of A-36 carbon steel representing a vehicle hull. The panel size was selected based on the floor surface area of a typical candidate military vehicle. For each test sample 301 the aluminum panel 307 was assembled to the steel panel 309 with 26 bolted joints 311 using ½ inch diameter partially threaded bolts and threaded weld bushings. The types of bolted joints 311 tested were the Baseline, Concept #1, and Concept #2 designs described above in reference to the Small Scale Field Blast Test of FIG. 6. The bolt materials were again Grade 8 alloy steel for the Baseline, and 304 Stainless Steel for the Concept #1 and #5 joints. A TNT explosive charge was placed on the concrete pad 305 approximately under the center of test sample 301.

The results of the full scale blast simulation tests are summarized in Table 2. All tests were performed using 13.6 lbs. of UNIGEL brand TNT explosive. Of the 52 total Baseline Grade 8 bolts tested at bolted joints 311, only 17, or 33%, remained intact (not destroyed) after the blast event. In contrast, 44, or 85% of the Stainless Steel Concept #1 bolts, and 100% of the Stainless Steel Concept #5 bolts were intact after the blast event and prior to disassembly of the test sample.

TABLE 4

Full Scale Blast Simulation Results (13.6 lbs TNT)

| ArmorWorks Test | Concept | Hardware Material | Broke on Disassembly | Destroyed |
|---|---|---|---|---|
| GA1C | Baseline | Grade 8 | | 23 |
| GA2B | Baseline | Grade 8 | | 12 |
| GB1B | #1 | SS 304 | | 4 |
| GB2 | #1 | SS 304 | 2 | 4 |
| GC1 | #5 | SS 304 | 2 | |
| GC2 | #5 | SS 304 | 3 | |

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

What is claimed is:

1. A system for attaching a rigid armor plate to the exterior of a vehicle hull, comprising:

an armor attachment point on the vehicle hull;

an oversized hole through the armor plate in alignment with the armor attachment point;

a fastener extending through the oversized hole and attaching the armor plate to the armor attachment point, the fastener and oversized hole cooperatively defining a circumferential gap there-between;

a washer-shaped pivot cup disposed in a countersink in an exterior end of the oversized hole in the armor plate;

a spherical countersink in an inner diameter of an exterior side of the pivot cup; and a pivot washer trapped between an end of the fastener and the pivot cup, the pivot washer having a spherical surface configured for pivoting engagement with the spherical countersink in the pivot cup.

2. The system of claim 1, wherein the inner diameter of the pivot cup is substantially greater than an outer diameter of the fastener.

3. The system of claim 2, wherein the pivot cup and pivot washer are made of a harden-able material.

4. The system of claim 1, further comprising an elastic spacer around the fastener between the armor plate and the vehicle hull.

5. The system of claim 1, wherein the fastener is a threaded bolt with a head, and the armor attachment point comprises an internally threaded weld bushing.

6. The system of claim 1, wherein the fastener material has an energy absorption capability in excess of 2000 ksi.

7. The system of claim 1, wherein the fastener material has an energy absorption capability in excess of 5000 ksi.

8. The system of claim 1, wherein the fastener is a threaded bolt made of 304 Stainless Steel.

9. A system for attaching a rigid armor plate to the exterior of a vehicle hull, comprising:

an armor attachment point on the vehicle hull;

a hole through the armor plate in alignment with the armor attachment point;

a fastener extending through the hole and attaching the armor plate to the armor attachment point, wherein the fastener material has an energy absorption capability in excess of 2000 ksi;

a washer-shaped pivot cup disposed in a countersink in an exterior end of the oversized hole in the armor plate;

a spherical countersink in an inner diameter of an exterior side of the pivot cup; and a pivot washer trapped between an end of the fastener and the pivot cup, the pivot washer having a spherical surface configured for pivoting engagement with the spherical countersink in the pivot cup.

10. The system of claim 9, wherein the fastener material has an energy absorption capability in excess of 5000 ksi.

11. The system of claim 9, wherein the fastener is a threaded bolt made of 304 Stainless Steel.

12. The system of claim 9, wherein the diameter of the fastener is less than the diameter of the hole through the armor plate, defining a substantial gap there-between.

13. The system of claim 12, further comprising an elastic insert bushing disposed about the fastener, substantially filling the gap between the fastener and the hole through the armor plate.

14. The system of claim 13, wherein the elastic insert bushing material is selected from the group comprising rubber, and polyurethane.

15. The system of claim 9, further comprising an elastic spacer around the fastener between the armor plate and the vehicle hull.

16. The system of claim 15, wherein the elastic spacer material is selected from the group comprising rubber, and polyurethane.

* * * * *